US007415981B1

(12) United States Patent
Pinson et al.

(10) Patent No.: US 7,415,981 B1
(45) Date of Patent: Aug. 26, 2008

(54) FILTER PAD AND PROTECTIVE HOOD

(75) Inventors: Jay D. Pinson, San Jose, CA (US); Michael B. Jennings, San Jose, CA (US); Raymond Brindos, Gardnerville, NV (US)

(73) Assignee: Lifeline Tech, Inc., San Jose, CA (US)

( * ) Notice: Subject to any disclaimer, the term of this patent is extended or adjusted under 35 U.S.C. 154(b) by 657 days.

(21) Appl. No.: 11/028,778

(22) Filed: Jan. 3, 2005

(51) Int. Cl.
*A62B 23/02* (2006.01)

(52) U.S. Cl. ..... 128/201.25; 128/205.29

(58) Field of Classification Search ..... 128/201.25, 128/206.12–206.19, 205.29; 55/385.1, DIG. 33, 55/DIG. 35, DIG. 42, DIG. 45
See application file for complete search history.

(56) References Cited

U.S. PATENT DOCUMENTS

| | | | | | |
|---|---|---|---|---|---|
| 3,042,034 | A | * | 7/1962 | Gruenewaelder | 128/206.12 |
| 3,521,630 | A | * | 7/1970 | Westberg et al. | 128/206.15 |
| 3,789,839 | A | | 2/1974 | Lund et al. | 128/142.7 |
| 4,032,991 | A | | 7/1977 | Vandeweghe | 2/173 |
| 4,141,703 | A | * | 2/1979 | Mulchi | 96/132 |
| 4,231,118 | A | | 11/1980 | Nakagawa | 2/7 |
| 4,382,440 | A | | 5/1983 | Kapp et al. | 128/201.25 |
| 4,411,023 | A | | 10/1983 | Pinson | 2/7 |
| 4,463,757 | A | * | 8/1984 | Schmidt | 128/205.29 |
| 4,589,408 | A | | 5/1986 | Singer | 128/132 R |
| 4,790,307 | A | * | 12/1988 | Haber et al. | 128/206.19 |
| 4,870,959 | A | | 10/1989 | Reisman et al. | 128/201.25 |
| 5,146,636 | A | | 9/1992 | De La Pena | 2/202 |
| 5,452,712 | A | | 9/1995 | Richardson | 128/201.25 |
| 5,666,950 | A | * | 9/1997 | Smith | 128/207.14 |
| 5,941,244 | A | * | 8/1999 | Yamazaki et al. | 128/206.19 |
| 6,340,024 | B1 | | 1/2002 | Brookman et al. | 128/201.25 |
| 6,742,518 | B2 | * | 6/2004 | Chang | 128/205.29 |
| 7,101,423 | B2 | * | 9/2006 | Lersch et al. | 96/68 |

* cited by examiner

*Primary Examiner*—Steven O Douglas
(74) *Attorney, Agent, or Firm*—Schneck & Schneck; Thomas Schneck

(57) ABSTRACT

A filter pad, particularly for a protective hood or smoke mask, has a flow distributor and an adjacent underlying filter layer. The flow distributor, which is impermeable or substantially impermeable to gas, diverts gas flow and directs flow in the underlying filter layer thus increasing or maximizing resident time for filtering in the filter layer. The filter pad may include one or more flow distributors and one or more filter layers. The filter pad may be incorporated into a protective hood that is provided for the protection of individuals in the event of fire or other disaster. The hood includes a transparent, low flammability cover having an opening therein with the filter pad exposed through the opening, the hood being disposed over and completely around the head of a wearer with a bottom thereof extending to a neck of the wearer.

11 Claims, 4 Drawing Sheets

FILTER PAD AND PROTECTIVE HOOD

TECHNICAL FIELD

The present invention relates to protective breathing devices, in general, and to filter pads and protective hoods, in particular.

BACKGROUND OF THE INVENTION

It is of the utmost importance that during a disastrous situation, such as a fire or toxic chemical leak, that a person caught in the disaster will have access to a protective breathing device that will provide adequate protection from smoke, gases, fumes, or other contaminants for an amount of time necessary to escape the disaster.

Smoke protective hoods have been provided for the protection of wearers from dangerous conditions such as smoke inhalation. For example, U.S. Pat. No. 4,411,023 to Pinson describes a hood for protecting the wearer from poisonous fumes and the like including a respirator having a portion arranged to be gripped in the mouth of the user.

U.S. Pat. No. 5,146,636 to De La Pena describes a heat and smoke protective hood that comprises a bag-like head covering having a filter and a skirt extending about the covering.

U.S. Pat. No. 4,589,408 to Singer describes a head covering having a face mask portion and a rear portion which surrounds the head of the wearer for exclusion of bacteria while retaining air permeability.

Though previous protective breathing devices may provide protection from the material against which protection is required, it is important that any filter pad or other filtering mechanism within the protective devices work efficiently in filtering contaminants. Further, it is important that protective devices can be efficiently stored and readily accessed by the user in his time of need.

Therefore, it is an object of the present invention to provide a new and improved filter pad.

It is an object of the present invention to provide a filter pad that provides a wearer with breathable air.

It is another object of the present invention to provide a new and improved protective hood.

It is an object of the present invention to provide a protective hood that is efficiently stored.

It is an object of the present invention to provide a protective hood that is readily accessed.

It is an object of the present invention to provide a protective hood that provides breathable air to a wearer when contaminants are present in the local environment.

SUMMARY OF THE INVENTION

Objects of the present invention have been met by a filter pad, particularly for use with a protective hood, which includes at least one flow distributor that directs gas flow, such as gas flow from smoke or other gases or noxious gases, through a flow path parallel to at least one adjacent filter layer to maximize, or at least increase, contact time between the gas and the filter material. The flow distributor is comprised of a material, such as a non-woven material, that is substantially impermeable or completely impermeable to gas. Where a material is described as completely impermeable, it can also be described as substantially impermeable. The adjacent filter element is comprised of a material, such as a woven material which may be impregnated with chemicals that remove hazardous components from the gas. The flow distributor covers a portion of the adjacent filter element of the filter pad and, due to its impermeability, diverts gas flow to the adjacent filter element portion that is uncovered by the flow distributor. This movement allows for efficient use of most or all of the filter element area. The flow distributor is advantageous in that it efficiently directs flow within a filter element of the filter pad and provides more residence time for adsorption or other types of filtering and increased filter efficiency.

One or more additional arrangements of one or more flow distributors, adjacent filter elements, and additional filter elements may be used in the filter pad. Once the gas has passed through the filter pad, contaminants have been removed and breathable air reaches the wearer. One or more flow distributors may be placed in different covering positions relative to each adjacent filter element to direct flow in the adjacent filter element as desired. In one embodiment of the present invention, a flow diverter is comprised of a series of flow distributors with alternating flow openings. Filter elements are located between and/or adjacent to the flow distributors. When the contaminant flow is drawn into a space between a flow distributor and an adjacent filter element, it is directed parallel to a surface of the filter pad. The result is a serpentine flow pattern that maximizes, or at least increases, the contact time between the gas and filter elements. In addition to protection against inhalation of toxic gas, the filter pad may be used to protect against a variety of contaminants, such as particulates or liquid aerosols and droplets.

The filter pad described above, as well other types of filter pads, may be utilized within a protective hood including a transparent, low-flammability cover having an opening therein with a filter pad exposed through the opening. The hood is disposed over and completely around the head of a wearer with a bottom thereof extending to a neck of the wearer. The hood may comprise various colors through which the user may see.

In one embodiment of the present invention, the protective hood of the present invention includes a filter pad that is creased along a length and along a width of the filter pad and includes a foldable covering. The creased portions facilitate folding of the filter pad, which depending on how many layers of filter are present, may be relatively thick. The entire protective hood is capable of being folded into a relatively small form which provides for easy storage and access.

DETAILED DESCRIPTION OF THE INVENTION

Figure 1:
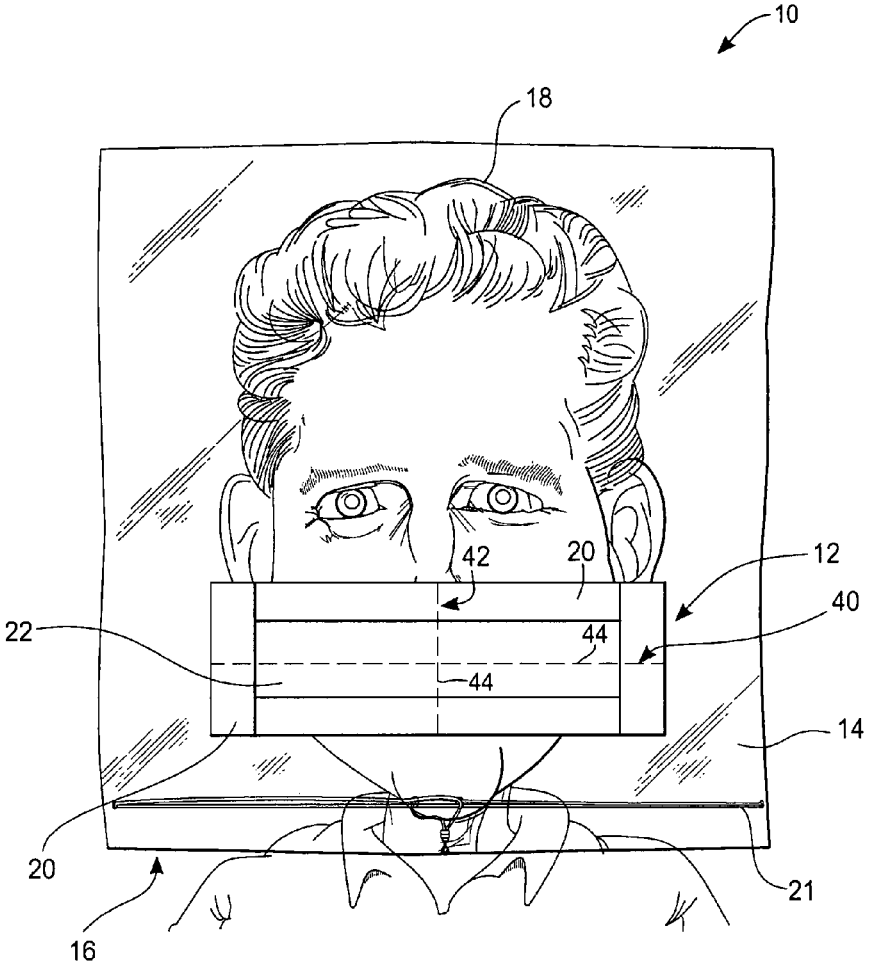
FIG. 1 is a perspective view of a protective hood of the present invention including a front view of a filter pad of the present invention.
Figure 2:
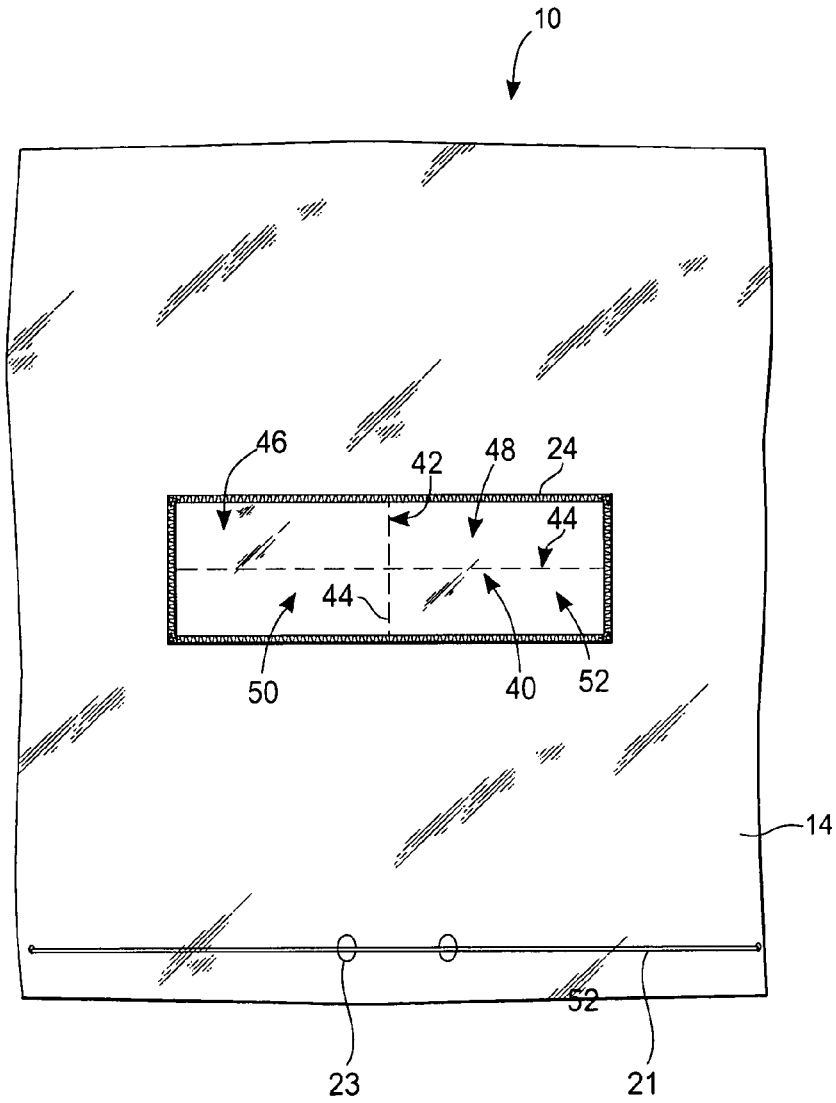
FIG. 2 is a rear view of the protective hood of FIG. 1 without a wearer.

With reference to FIGS. 1 and 2, there is seen a protective hood 10 of the present invention featuring a filter pad 12. The protective hood comprises a transparent, low flammability cover 14 having an opening (not shown) therein which is covered by the filter pad 12 and an opening 16 within which a user 18 inserts his head such that the cover is disposed over and completely around the head of a wearer with a bottom thereof extending to a neck of the wearer. The cover extends continuously in a single sheet to the neck of the user on either side. Adhesive tape 20 attaches the filter pad 12 to the bag to cover the opening and it is applied so that an outer surface 22 of the filter pad 12 remains exposed. The cover may comprise, for example, a soft nylon material or KAPTON. The cover is transparent so that a user may see through it. The cover may comprise colors through which the user may see. The protective hood includes a draw string 21 threaded through openings 23 around the hood at the neck area of the wearer so that the bottom of the hood may be effectively closed by drawing the hood close around the neck area of the wearer without preventing the exhaling of air by the wearer and enabling the venting of exhaled air to atmosphere through the bottom of the hood. Drawstring 21 encircles a lower portion of cover 14. A filter pad, other than filter pad 12, may be utilized in the protective hood, if desired.

In the depicted example, the protective hood cover 14 is rectangular in shape and is approximately 52 cm in length and 46 cm in width. In one example, the filter pad is approximately 30 cm in length, 9.5 cm in width, and has a thickness of approximately 6 mm.

Figure 3:
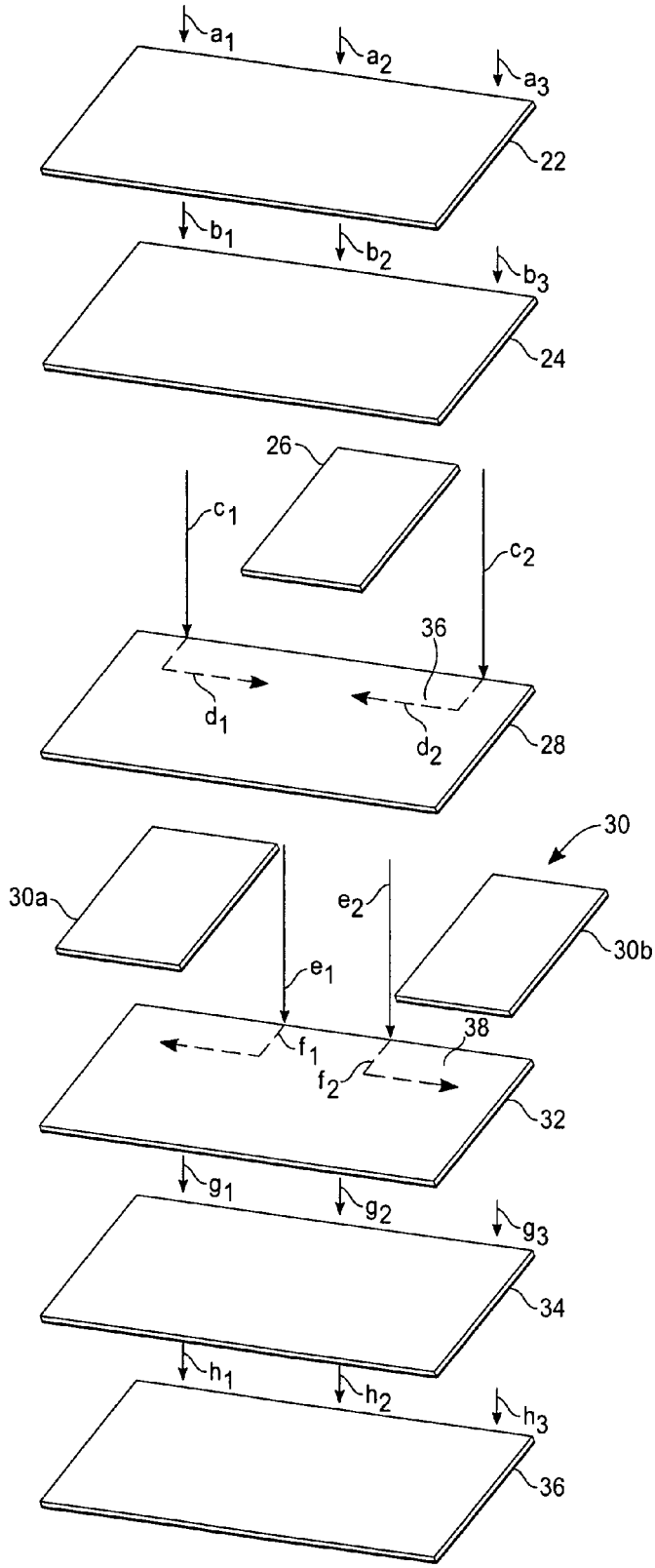
FIG. 3 is an exploded view of the filter pad of FIG. 2.

With reference to FIG. 3, layers of the filter pad 12 are seen. Each of the various layers is disposed adjacent to the next layer and is, for example, planar or substantially planar. The layers may be attached to one another by stitching 24 (FIG. 2) or a perimeter adhesive. Layer 22 of the filter pad 12 is a filter element which filters out, for example, large particulates such as soot, ash, and aerosols. In one example, layer 22 comprises a woven material, such as a cotton cloth. Layer 22 is directly exposed to the environment outside of the covering. Layer 22 is, for example, approximately 1 mm in thickness.

Layer 24, adjacent to and between layers 22 and 26, is another filter element which comprises for example, one or more woven materials. The woven materials may be chemically impregnated or not. The woven material is, for example, more closely woven than layer 22 so as to be capable of filtering smaller particulates of for example, dust, soot, ash, and aerosols. Layer 24 is approximately 0.5 mm in thickness.

Layer 26 is a flow distributor which is substantially impermeable to the gas being filtered and which is adjacent to and between layers 24 and 28. It is comprised of, for example, a non-woven material such as a special non-porous paper which at least substantially, and preferably completely, blocks gas flow in addition to blocking passage of other undesirable materials such as blood, an aerosol-like particulate. Layer 26 is, for example, then and less than 0.1 mm in thickness.

Layer 28 is a filter element which filters, for example, noxious gases and aerosols and which is adjacent to and between layers 26 and 30. It is comprised of, for example, a carbon impregnated material, such as carbon impregnated polyester. Filter element 28 and/or other woven filter elements may include multiple layers or multiple layers of chemically impregnated woven material. The material of layer 28 is, for example, woven. Layer 28 may be a low density woven material. In one example, layer 28 is a close netted woven cloth material. The carbon particles are, in one example, fine granulated particles that provide a large surface area to projected area ratio, such as a ratio of approximately 100 to 1 actual surface area to projected (cross-sectional) area. The carbon particles provide maximum area for a high rate of absorption. Layer 28 is approximately 1.5 mm in thickness. In one embodiment, one or more filter elements is impregnated with metal oxides to convert CO to $CO_2$ and thus reduce the amount of CO in the breathable air. In one example, CuO—$MnO_2$ or copper zinc oxides are used for filter element impregnation to convert CO to $CO_2$ and thus reduce the amount of CO in the breathable air.

Layer 30 includes flow distributors 30*a* and 30*b* which are substantially impermeable to the gas being filtered and which are adjacent to and between layers 28 and 32. Each flow distributor 30*a* and 30*b* is comprised of, for example, a non-woven material such as a special non-porous paper which substantially blocks gas flow in addition to blocking passage of other undesirable materials such as blood. Each flow distributor 30*a* and 30*b* is less than 0.1 mm in thickness.

Layer 32 is a filter element which is adjacent to and between flow distributors 30*a*, 30*b*, and layer 34 and which filters, for example, noxious gases and aerosols. It is comprised of, for example, a carbon impregnated material, such as the material described above with regard to layer 28. The material of layer 32 is, for example, woven. Layer 32 is, for example approximately 1.5 mm in thickness.

Layer 34 is a filter element which is adjacent to and between layers 32 and 36 and which filters for example, moisture, aerosols, inhaled air and/or gases, and exhaled air and/or gases. It is comprised of, for example, a molecular sieve which may include, for example, zeolite. The material of layer 34 is, for example, woven. Layer 34 is, for example, approximately 1 mm in thickness.

Layer 36 is a filter element which is disposed adjacent to layer 34 and which is in, or is capable of, contact with the wearer of the protective hood or other mechanism incorporating the filter pad 12. In one example, layer 36 is a woven material such as a cloth. It is preferable that the cloth comprise a soft material as it will likely be in contact with the wearer's face. Layer 36 is, for example, approximately 0.2 mm in thickness.

The filter pad 12 is provided with a mechanism which allows the filter pad to be located relative to the user in a position to filter out undesired matter, such as soot, ash, dust aerosols, other particulates and certain gases, so that the user is provided with breathable air. Typically, the filter pad is disposed in front of the user's nose and mouth. In one example, the filter pad 12 may comprise a part of the protective hood 10 and the protective hood assists in positioning the filter pad relative to the user. Alternatively, the filter pad 12 may comprise a part of another device which can be used to position and/or secure the filter pad relative to the wearer. For instance the filter pad 12 may be attached to the wearer's face by tie strings (not shown), and goggles (not shown) may be utilized to protect the wearer's eyes from harmful matter, such as noxious gases.

The operation of the filter pad 12 will be described below in conjunction with the protective hood 10, though other mechanisms for positioning the filter relative to the user may be used. A user places the protective hood 10 over his head and tightens the drawstring 21 so that the bottom of the hood may be effectively closed by drawing the hood close around the neck area of the wearer 18 without preventing the exhaling of air by the wearer and enabling the venting of exhaled air to atmosphere through the bottom of the hood 10. The closure around the neck is adequate to restrict air flow around the neck so air is preferentially inhaled through the filter.

As the wearer inhales, matter, such as air, that is present in the local environment is drawn through the filter pad 12 in the direction indicated by the arrows of FIG. 3. One or more types of matter are typically filtered at each layer of the filter pad 12, as described above.

During use of the filter pad 12, inhaled matter such as gas, is drawn in the direction of arrows $a_1$, $a_2$ and $a_3$ and certain matter, as described above with regard to layer 22, is filtered at layer 22. Matter that was not filtered out at filter 22 is drawn in the direction of arrows $b_1$, $b_2$, and $b_3$.

Matter, including for example gas, that is not filtered out at filter 24 is drawn to filter 28, as indicated by arrows $c_1$ and $c_2$. Layer 26 is in a covering relation with less than an entire major surface 36 of layer 28. In the example of filter pad 12, layer 26 is disposed on a center portion of major surface 36. Because layer 26 is substantially or completely impermeable to one or more gases to be filtered, gas will be substantially prevented from flowing to filter 28 through flow distributor 26 as indicated by the lack of arrows directly above layer 26. Gas flow will continue along either side of the flow distributor 26 at openings as indicated by the arrows $c_1$ and $c_2$ to the filter 28. Therefore, most of the flow will initially contact filter 28 at portions of major surface 36 not covered by flow distributor 26, or at portions other than the center portion which, as stated above, is covered by the flow distributor 26. Typically, gas first flows to filter 28 at side portions uncovered by the flow distributor, as indicated by the arrows $c_1$ and $c_2'$ located at the sides of the distributor 26. Gas flow is diverted by the flow distributor and is directed as indicated by arrows $d_1$ and $d_2$ parallel to, and across and/or through filter element 28, providing more residence time for adsorption and increased filter efficiency. The contact/exposure time between the gas and filter element 28 is maximized or at least increased.

Matter, including for example gas, that is not filtered out of filter 28 is drawn to filter 32, as indicated by arrows $e_1$ and $e_2$. Flow distributors 30*a* and 30*b* are each in a covering relation with less than an entire major surface 38 of layer 32. In this example, the two flow distributors are disposed on side portions of major surface 38. Because flow distributors 30*a* and 30*b* are substantially or completely impermeable to one or more gases to be filtered, gas will be substantially prevented from flowing to filter 32 through flow distributors 30*a* and 30*b*, as indicated by the lack of arrows directly beneath flow distributors 30*a* and 30*b*. Thus, the gas flow will continue in between flow distributors 30*a* and 30*b* at an opening as indicated by arrows $e_1$ and $e_2$. Therefore, most of the flow will initially contact filter 32 at a portion of major surface 38 not covered by flow distributors 30*a* and 30*b*, or at a portion other than the side portions which, as stated above, are covered by the flow distributors 30*a* and 30*b*. Typically, gas first flows to filter 32 at a center portion uncovered by the flow distributors 30*a* and 30*b*, as indicated by the arrows $e_1$ and $e_2$ located at the side of the flow distributors. Gas flow is diverted by the flow distributors and is directed, as indicated by the arrows $f_1$ and $f_2$, parallel to, and across and/or through filter element 32, providing more residence time for adsorption and increased filter efficiency. The contact/exposure time between the gas and filter element 32 is maximized or at least increased.

Matter that is not filtered out at filter 32 is drawn to filter 34, as indicated by arrows $g_1$, $g_2$, and $g_3$. Matter that is not filtered out at filter 34 is drawn to filter 36, as indicated by arrows h1, h2, and h3. Although filter 36 may provide some filtering functions, by the time the matter reaches filter, 36 it is typically breathable air for the wearer.

Each flow distributor may cause a pressure differential at the adjacent filter layer of the filter pad 12 which causes movement of gas in a particular direction. A pressure differential may form when the flow distributor directs gas flow away from the flow distributor and to particular portions of the adjacent filter. The invention is advantageous in at least that matter, such as gas containing contaminants, is exposed to a filter element for an increased or even a maximum amount of time as a result of the diverting action of the flow distributor. Therefore, the filter pad is highly efficient in providing breathable air to the wearer.

The position, number, and size of flow distributors may vary as desired. The position, number, and size of the flow distributors may cause the gas or other matter to be directed in various directions across and through filters.

Any desired filter pad size may be used. In one embodiment, one or more filter pads are used. In another embodiment, the filter pad may extend around an entire hood surface. Various arrangements of the flow distributor(s) may be used to selectively direct gas or other matter flow through the filter pad in various desired directions.

With reference to FIGS. 1 and 2, filter pad is creased along its length and width at creases 40 and 42, respectively. The creases form segments 46, 48, 50, and 52. In the depicted example, the filter pad is creased along its entire central length and along its entire central width. The creases may be formed by folding or by stitching the layers of the filter pad 12 together so that stitches 44 form creases 40 and 42. Adhesive 20 is also creased by folding.

Figure 4A:
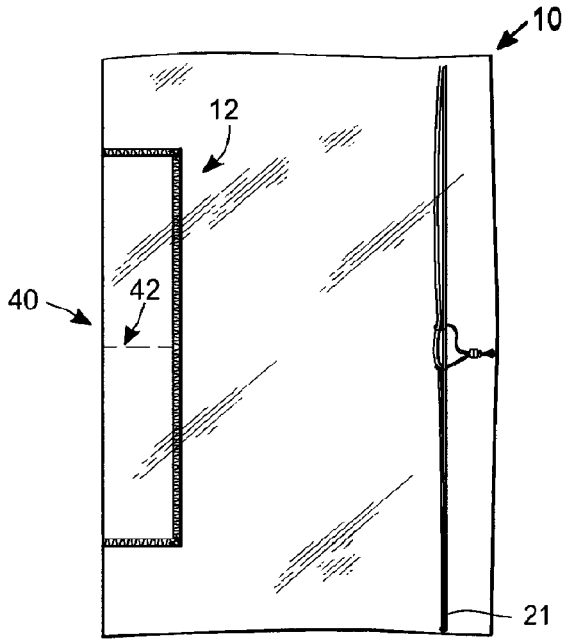
FIG. 4*a* is a perspective view of the protective hood of FIG. 1 folded once.
Figure 4B:
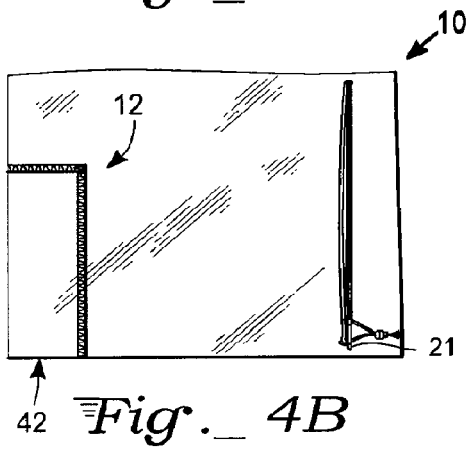
FIG. 4*b* is a perspective view of the protective hood of FIG. 4*a* folded.
Figure 4C:
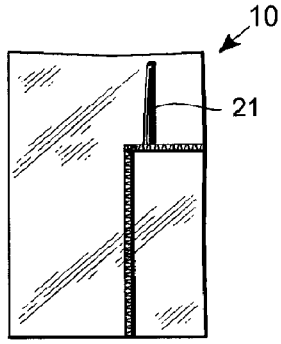
FIG. 4*c* is a perspective view of the protective hood of FIG. 4*b* folded.

In FIG. 4*a*, filter pad 12 is folded in half along crease 40 and cover 14. In FIG. 4*b*, filter pad 12 is again folded in half along crease 42 and cover 14. In FIG. 4*c*, cover 14 is folded in areas outside of pad 12. By folding the protective hood 10 along the creases of the filter pad 12 and at various locations along the cover 14, the protective hood is substantially decreased in size. Therefore, it can be easily stored and packaged for convenient access. Creases may be formed along various positions of the filter pad 12 and cover 14.

What is claimed is:

1. A filter pad comprising:

a first filter layer having a major surface and made of woven material; and a first flow distributor disposed adjacent said first filter layer and in a covering relation with less than the entire major surface of said first filter layer, said first flow distributor made of non-woven material that is substantially impermeable to gas flowing through the first filter layer;

a second filter layer having a major surface and made of woven material adjacent to the first flow distributor in a position filtering gas flowing past the first flow distributor;

a second flow distributor in a layer disposed adjacent said second filter layer in a covering relation with less than the entire major surface of said second flow distributor receiving gas flowing through the second filter layer, said second flow distributor made of non-woven material that is substantially impermeable to gas; and a third filter layer having a major surface and made of woven material disposed adjacent said second flow distributor layer in a position receiving and filtering flow therefrom.

2. The filter pad of claim 1 wherein said second filter layer is carbon impregnated polyester.

3. A filter pad comprising:

a first filter layer;

a second filter layer disposed adjacent to said first filter layer;

a third filter layer having a major surface;

a first flow distributor layer having a first flow distributor disposed between said second and third filtering layers and in covering relation with less than the entire major surface of said third filter layer, said flow distributor layer substantially impermeable to gas;

a fourth filter layer having a major surface;

a second flow distributor layer having a second flow distributor and a third flow distributor each disposed adjacent to said fourth filter layer and in covering relation with less than the entire major surface of said fourth filter layer, said second flow distributor layer substantially impermeable to gas;

a fifth filter layer disposed adjacent to fourth filter layer; and a sixth filter layer disposed adjacent to said fifth filter layer.

4. The filter pad of claim 3 wherein said third filter layer comprises polyester impregnated carbon.

5. The filter pad of claim 3 wherein said third filter layer is a metal oxide impregnated filter layer.

6. The filter pad of claim 3 wherein said fourth filter layer comprises polyester impregnated carbon.

7. The filter pad of claim 3 wherein said fourth filter layer is a metal oxide impregnated filter layer.

8. The filter pad of claim 3 wherein said fifth filter layer includes a molecular sieve.

9. The filter pad of claim 3 wherein said sixth filter layer comprises cloth.

10. The filter pad of claim 3 wherein said first, second, and third flow distributors are made of non-woven material.

11. The filter pad of claim 3 wherein said first, second, and third flow distributors are made of paper.

* * * * *